US010698331B2

(12) United States Patent
Obara et al.

(10) Patent No.: US 10,698,331 B2
(45) Date of Patent: Jun. 30, 2020

(54) TWO-COMPONENT DEVELOPER FOR ELECTROSTATIC CHARGE IMAGE DEVELOPMENT

(71) Applicant: Konica Minolta, Inc., Tokyo (JP)

(72) Inventors: Shinya Obara, Tokyo (JP); Koji Shibata, Tokyo (JP); Junya Ueda, Tokyo (JP); Takuya Takahashi, Tokyo (JP); Satoshi Uchino, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/404,179

(22) Filed: May 6, 2019

(65) Prior Publication Data

US 2019/0354032 A1 Nov. 21, 2019

(30) Foreign Application Priority Data

May 17, 2018 (JP) ..... 2018-095374

(51) Int. Cl.

| | |
|---|---|
| ***G03G 9/107*** | (2006.01) |
| ***G03G 9/113*** | (2006.01) |
| ***G03G 9/087*** | (2006.01) |
| ***G03G 9/08*** | (2006.01) |
| ***G03G 9/097*** | (2006.01) |

(52) U.S. Cl.

CPC ..... *G03G 9/1075* (2013.01); *G03G 9/087* (2013.01); *G03G 9/0823* (2013.01); *G03G 9/1132* (2013.01)

(58) Field of Classification Search

CPC .... G03G 9/1075; G03G 9/1132; G03G 9/087; G03G 9/0823; G03G 9/09708; G03G 9/1133; G03G 9/113

See application file for complete search history.

(56) References Cited

U.S. PATENT DOCUMENTS

| | | | | |
|---|---|---|---|---|
| 5,212,038 | A * | 5/1993 | Watanabe | G03G 9/0823 430/111.3 |
| 2004/0234877 | A1 | 11/2004 | Yoshino et al. | |
| 2009/0170020 | A1 | 7/2009 | Kubo et al. | |
| 2010/0040969 | A1* | 2/2010 | Bejat | G03G 9/0819 430/111.1 |
| 2016/0282742 | A1* | 9/2016 | Uchino | G03G 9/1133 |

FOREIGN PATENT DOCUMENTS

| | | | |
|---|---|---|---|
| JP | 2006-039023 | A | 2/2006 |
| JP | 2010-262156 | A | 11/2010 |
| JP | 2014-170131 | A | 9/2014 |

OTHER PUBLICATIONS

EPO, Extended European Search Report from the corresponding European Patent Application No. 19173272.6, dated Aug. 16, 2019 (8 pages).

* cited by examiner

*Primary Examiner* — Thorl Chea
(74) *Attorney, Agent, or Firm* — Lucas & Mercanti, LLP

(57) ABSTRACT

To provide a two-component developer for electrostatic charge image development, the two-component developer enabling a high image quality to be kept and enabling the occurrence of fogging to be suppressed even in continuous printing of an image high in coverage rate. The two-component developer for electrostatic charge image development includes a toner particle including a toner base particle and an external additive disposed on the surface of the toner base particle, and a carrier particle including a core material particle and a covering section disposed on the surface of the core material particle, wherein the external additive includes an alumina particle, and the percentage of exposed area of the core material particle is 4.0% or more and 15.0% or less.

6 Claims, No Drawings

TWO-COMPONENT DEVELOPER FOR ELECTROSTATIC CHARGE IMAGE DEVELOPMENT

CROSS REFERENCE TO RELATED APPLICATIONS

The entire disclosure of Japanese patent Application No. 2018-095374, filed on May 17, 2018, is incorporated herein by reference in its entirety.

BACKGROUND

Technological Field

The present invention relates to a two-component developer for electrostatic charge image development.

Description of Related Art

Toner for use in printing is demanded to have higher performances along with the popularization of copying machines and printers. In recent years, digital printing techniques have attracted attentions, such techniques being called print-on-demand (POD) techniques for direct printing without any plate making. POD is superior to conventional offset techniques because POD can cope with both small-lot printing and variable printing where the content of printing is varied with respect to each sheet.

It is important for application of electrophotographic image forming methods to POD that not only the speed of printing be increased to result in a reduction in running cost, but also outputting at a variety of coverage rates can be made and a highly fine image can be stably output even in a variety of environments. In particular, in the graphic art field where the coverage rate is high, continuous outputting of an image high in coverage rate causes an external additive to be easily transferred from toner to a carrier and causes chargeability of the carrier to be deteriorated, thereby resulting in a reduction in the amount of charge of toner. Thus, application of electrophotographic image forming methods to POD is supposed to cause fogging to the background and/or toner dust in transferring to occur, thereby making stable outputting of a highly fine image difficult.

In order to solve the problems, Japanese Patent Application Laid-Open No. 2006-039023 discloses a technique where a plurality of external additives different in particle size, different in shape, and different in work function are used to thereby prevent such external additives from being released from a toner base particle, resulting in stabilization of chargeability. Japanese Patent Application Laid-Open No. 2006-039023 discloses a toner including a toner particle having a toner base particle and external additives. The external additives include hydrophobic, negatively chargeable silica and hydrophobic rutile anatase type titanium (titania particle) which are different in average primary particle size.

The toner described in Japanese Patent Application Laid-Open No. 2006-039023 allows releasing of a titania particle to be suppressed by negatively chargeable silica having a large particle size, but the titania particle is low in resistance and thus even only a small amount of charge is transferred to a carrier particle to thereby promote charge movement to the carrier particle, resulting in a reduction in the amount of charge of the toner. It is also considered that the titania particle is surface-modified by a large amount of a surface modifier so as to have any resistance compatible with the resistance of the carrier particle.

Japanese Patent Application Laid-Open No. 2014-170131 discloses a method of adjusting the resistance of a carrier particle by itself. In general, the resistance value of a core material particle for use in a covered carrier particle is low and the resistance value of a material for use in a covering section is high, and thus the resistance value of such a carrier particle can also be modulated by the covering section on the surface of the carrier particle. Japanese Patent Application Laid-Open No. 2014-170131 discloses a technique that allows a metal oxide such as carbon black, tin oxide, titanium oxide, or zinc oxide to be dispersed in a covering section, resulting in adjustment of the resistance value of the covering section.

The technique described in Japanese Patent Application Laid-Open No. 2006-039023 may cause the titania particle to be aggregated, resulting in easy releasing from the toner base particle, thereby causing the surface of the carrier particle to be contaminated. Contamination of the surface of the carrier particle by an external additive causes the toner to be unstabilized in flow properties and has an influence on conveyance properties of the toner, resulting in the variation in image quality. The technique described in Japanese Patent Application Laid-Open No. 2014-170131 may cause the covering section to be significantly deteriorated in charge retention ability in the case of addition of a large amount of a resistance adjuster. The technique may have the problem of attachment of the resistance adjuster onto the toner in wastage of the covering section. Furthermore, a small amount of the resistance adjuster added causes the initial resistance of a carrier to be too high, thereby facilitating the remaining of any reverse charge to that of the toner, in the particle, resulting in a reduction in image density upon continuous printing. Thus, there is room to study an increase in quality of an image formed and suppression of the occurrence of fogging, which are simultaneously achieved.

SUMMARY

An object of the present invention is to provide a two-component developer for electrostatic charge image development, the two-component developer enabling a high image quality to be kept and enabling the occurrence of fogging to be suppressed even in continuous printing of an image high in coverage rate.

To achieve at least one of the abovementioned objects, according to an aspect of the present invention, a two-component developer for electrostatic charge image development, reflecting one aspect of the present invention comprises: a toner particle comprising a toner base particle and an external additive disposed on a surface of the toner base particle; and a carrier particle comprising a core material particle and a cover disposed on a surface of the core material particle, in which the external additive comprises an alumina particle, and a percentage of exposed area of the core material particle is 4.0% or more and 15.0% or less.

To achieve at least one of the abovementioned objects, according to an aspect of the present invention, a two-component developer for electrostatic charge image development, reflecting one aspect of the present invention comprises: a toner particle comprising a toner base particle and an external additive disposed on a surface of the toner base particle; and a carrier particle comprising a core material particle and a cover disposed on a surface of the core material particle, in which the external additive comprises an alumina particle, and a shape factor of the core material particle is 115 to 150.

DETAILED DESCRIPTION OF EMBODIMENTS

Hereinafter, one or more embodiments of the present invention will be described. However, the scope of the invention is not limited to the disclosed embodiments.

<Configuration of Two-Component Developer for Electrostatic Charge Image Development>

The two-component developer for electrostatic charge image development includes a carrier particle and a toner particle.

Examples of the carrier particle include a magnetic particle made of any known material, for example, a metal such as iron, ferrite, and magnetite, and an alloy of such a metal with a metal such as aluminum and lead. Examples of the carrier particle include a covered carrier particle including a core material particle made of a magnetic material and a covering section including a covering material with which the surface of the core material particle is covered, and a resin-dispersed carrier particle obtained by dispersing a fine powder of a magnetic material in a resin. The carrier particle is preferably a covered carrier particle from the viewpoint that a photoconductor is inhibited from being attached to the carrier particle.

The core material particle is, for example, a magnetic material that is to be strongly magnetized by a magnetic field in the direction of the field. The magnetic material may be used singly or in combinations of two or more kinds thereof. Examples of the magnetic material include metals exhibiting ferromagnetic properties, such as iron, nickel and cobalt, alloys or compounds including such metals, and alloys exhibiting ferromagnetic properties due to a heat treatment.

Examples of such metals exhibiting ferromagnetic properties or compounds including such metals include iron, ferrite represented by the following formula (a), and magnetite represented by the following formula (b). Each M in formula (a) and formula (b) represents one or more monovalent or divalent metals selected from the group consisting of Mn, Fe, Ni, Co, Cu, Mg, Zn, Cd and Li.

$$MO.Fe_2O_3 \quad \text{formula (a)}$$

$$MFe_2O_4 \quad \text{formula (b)}$$

Examples of such alloys exhibiting ferromagnetic properties include Heusler alloys such as manganese-copper-aluminum and manganese-copper-tin, and chromium dioxide.

The core material particle is preferably any of various ferrites. The specific gravity of the covered carrier particle is lower than the specific gravity of each metal constituting the core material particle. Thus, various ferrites can allow for a more reduction in the impact force of stirring in a developing unit.

The covering section is disposed on the surface of the core material particle. The covering section includes a covering material. The covering material may be used singly or in combinations of two or more kinds thereof. The covering material usable is any known resin for use in covering of the core material particle of the carrier particle. Examples of the resin for use as the covering material include a resin of any polyolefin such as polyethylene and polypropylene; a polystyrene resin; a (meth)acrylic resin such as a polymethyl methacrylate resin, a polyvinyl resin and a polyvinylidene resin of polyacrylonitrile, polyvinyl acetate, polyvinyl alcohol, polyvinyl butyral, and polyvinyl chloride; a resin of any copolymer such as a vinyl chloride-vinyl acetate copolymer and a styrene-acrylic acid copolymer resin; a silicone resin having an organosiloxane bond, or a modified resin thereof; a fluororesin such as a polyvinyl fluoride resin; a polyamide resin; a polyester resin; a polyurethane resin; a polycarbonate resin; an amino resin such as a urea-formaldehyde resin; and an epoxy resin. Examples of such a modified resin include a modified resin by an alkyd resin, a polyester resin, an epoxy resin, and polyurethane.

The resin for use as the covering material is preferably a cycloalkyl group-containing resin from the viewpoint of a reduction in moisture adsorbability of the carrier particle and from the viewpoint of an improvement in adhesiveness of the covering section to the core material particle. Examples of the cycloalkyl group include a cyclohexyl group, a cyclopentyl group, a cyclopropyl group, a cyclobutyl group, a cycloheptyl group, a cyclooctyl group, a cyclononyl group, and a cyclodecyl group. The cycloalkyl group is preferably a cyclohexyl group or a cyclopentyl group, and further preferably a cyclohexyl group from the viewpoint of adhesiveness of the covering section to the core material particle.

The weight average molecular weight (Mw) of the cycloalkyl group-containing resin is preferably 10,000 to 800,000, more preferably 100,000 to 750,000. The content of a constituent unit containing the cycloalkyl group in the resin is, for example, 10 to 90 mass %. The content of the cycloalkyl group in the resin can be determined by, for example, a known instrumental analysis method such as P-GC/MS and $^1$H-NMR.

The percentage of exposed area of the core material particle on the surface of the carrier particle at the primary stage is here 4.0% or more and 15.0% or less. The "primary stage" here means a stage where a toner particle and the carrier particle are mixed to produce a two-component developer for electrostatic charge image development. A percentage of exposed area of less than 4.0% leads to a too high resistance value of the carrier particle, resulting in an increased electrostatic adhesion force of the carrier particle to the toner particle and thus deterioration in turnover properties of the toner particle, thereby causing fogging and deterioration in image quality to occur. On the other hand, a percentage of exposed area of more than 15.0% leads to a reduction in the resistance value of the carrier particle by itself, resulting in a reduction in the amount of charge of the toner particle and thus deterioration in image quality.

The percentage of exposed area of the core material particle on the surface of the carrier particle can be measured by, for example, the following method. An XPS measurement apparatus (K-Alpha; manufactured by Thermo Fisher Scientific Inc.) is used, an Al monochromatic X-ray is used as an X-ray source, the accelerating voltage is set to 7 kV, and the emission current is set to 6 mV. Next, carbon as a main element constituting a covering layer is measured, and iron as a main element constituting the core material particle is measured. The measurement result of such carbon relative to the measurement result of such carbon and the measurement result of such iron is defined as the percentage of exposed area.

The average particle size of the carrier particle is preferably 20 to 100 μm, more preferably 25 to 80 μm, as the median size on a volume basis. The median size on a volume basis of the carrier particle can be measured by, for example, a laser diffraction particle size distribution measurement apparatus (HELOS; Sympatec GmbH) equipped with a wet dispersing machine.

The shape factor (SF-1) of the core material particle is 115 or more and 150 or less. A shape factor of less than 115 leads to the shape of a particle measured, close to a true sphere, and thus causes the bulk density (g/cc) of a carrier to be increased, resulting in excessive conveyance of the two-component developer for electrostatic charge image development to a development nip section to thereby cause fogging, toner scattering, or the like to occur. On the other hand, a shape factor of more than 150 leads to remarkable asperity unevenness on the surface of the core material particle, and causes voids to occur in the core material particle. Thus, magnetization per the core material particle is reduced, causing the carrier particle by itself to be developed on a photoconductor in a development nip section, resulting in the occurrence of defects such as scratches on the surface of the photoconductor. A core material particle having a shape factor of about 115 to 150 is produced by sintering at a sintering temperature set to a higher temperature of 1,300 to 1,500° C. than a conventional temperature.

The shape factor is determined by taking a picture of 100 or more particles selected randomly with a scanning electron microscope at a magnification of 150, capturing an image of the picture by a scanner, and subjecting the image to measurement with an image processing analysis apparatus LUZEX AP (Nireco). The shape factor (SF-1) of the core material particle is determined according to the following expression (1).

$$\text{SF-1}=(\text{Maximum length of particle})^2/(\text{Projected area of particle})\times(\pi/4)\times 100 \quad \text{Expression (1)}$$

The shape factor indicates the degree of asperity of the core material particle to be measured, and is more increased by more remarkable asperity unevenness.

The dynamic resistivity of the carrier particle is preferably $1.0\times10^8$ Ω·cm or more and $1.0\times10^{11}$ Ω·cm or less. A dynamic resistivity of the carrier particle, of less than $1.0\times10^8$ Ω·cm, may cause the charge retention ability of the carrier particle by itself to be deteriorated, thereby making maintaining of the amount of charge of the toner particle difficult. On the other hand, a dynamic resistivity of the carrier particle, of more than $1.0\times10^{11}$ Ω·cm, may cause any reverse charge to that of the toner particle on the carrier particle to be accumulated, resulting in an increased electrostatic adhesion force of the toner particle and the carrier particle and thus deterioration in turnover properties of the toner particle. Thus, fogging and deterioration in image quality may be caused to occur.

The dynamic resistivity of the carrier particle is determined with crystalline polyester resin c1 according to the following expression (2) by replacing an aluminum electrode drum having the same dimension as that of a photoconductor drum, with a photoconductor drum, feeding the carrier particle onto a development sleeve to form a magnetic brush, rubbing the magnetic brush with an electrode drum, and applying a voltage (500 V) between the sleeve and the photoconductor drum to measure a current flowing therebetween.

$$DVR(\Omega\cdot\text{cm})=(V/I)\times(N\times L/Dsd) \quad \text{Expression (2)}$$

DVR: resistance of carrier (Ω·cm)

V: voltage between development sleeve and drum (V)

I: current value measured (A)

N: width of development nip (cm)

L: length of development sleeve (cm)

Dsd: distance between development sleeve and photoconductor drum (cm)

In Examples described below, measurement was made at V=500 V, N=1 cm, L=6 cm, and Dsd=0.6 mm.

Examples of the method of producing the covered carrier particle, including the core material particle and the covering section, include a wet coating method and a dry coating method. Examples of such wet coating include a fluidized bed spray coating method, a dip coating method, and a polymerization method.

The "fluidized bed spray coating method" is a method including spray-coating the surface of a magnetic material particle with a coating solution including the resin for use as the covering material, dissolved in a solvent, by use of a fluidized bed, and then drying the resultant to produce the covering section. The "dip coating method" is a method including dipping a magnetic material particle in a coating solution including the resin for use as the covering material, dissolved in a solvent, for a coating treatment, and drying the resultant to produce the covering section. The "polymerization method" is a method including dipping a magnetic material particle in a coating solution including a reactive compound in a solvent, for a coating treatment, and then performing a polymerization reaction by application of heat or the like, to produce the covering section.

The "dry coating method" is a method including allowing the resin for use as the covering material to be attached onto the surface of the core material particle, and thereafter applying a mechanical impact force to melt or soften the resin attached onto the surface of the core material particle to fix the resin thereto, thereby producing the covering section. Specifically, the core material particle, the resin for use as the covering material, and a low-resistance fine particle are mixed, an impact force is repeatedly applied to the mixture at a high speed under non-heating or heating with a high-speed stirring-mixing machine that can impart a mechanical impact force, and the mixture is molten or softened to produce a carrier fixed on the surface of a magnetic material particle. The covering conditions in the case of heating are preferably as follows: the temperature is 80 to 130° C. the speed of wind that imparts an impact force is 10 m/s or more in heating, and is 5 m/s or less in cooling from the viewpoint of suppression of carrier particle aggregation, and the time during which the impact force is imparted is 20 to 60 minutes.

A two-component developer can be obtained by mixing the toner for electrostatic charge image development according to the present invention, and the carrier particle. The mixing apparatus for use in the mixing is not particularly limited. Examples of the mixing apparatus include a Nauta mixer, a W cone, and a V-type mixing machine. The content (toner concentration) of the toner particle in the two-component developer for electrostatic charge image development is not particularly limited, and is preferably 4.0 to 8.0 mass %.

The toner particle includes a toner base particle and an external additive. The toner base particle includes a crystalline resin as a binder resin.

(Crystalline Resin)

The crystalline resin is a resin having crystallinity. The "crystallinity" means that not a stepwise endothermic change, but a clear endothermic peak is observed in differential scanning calorimetry (DSC). The "clear endothermic peak" specifically means an endothermic peak having a full width half maximum within 15° C. measured at a rate of temperature rise of 10° C./min with DSC.

The crystalline resin is not particularly limited as long as the resin has the above characteristics. The crystalline resin usable is any conventionally known crystalline resin in the art. Examples of the crystalline resin include a crystalline polyester resin, a crystalline polyurethane resin, a crystalline polyurea resin, a crystalline polyamide resin, and a crystalline polyether resin. Such crystalline resins may be used singly or in combinations of two or more kinds thereof.

The crystalline resin is preferably a crystalline polyester resin from the viewpoint of capable of improving low-temperature fixability of a toner image to a recording medium. The "crystalline polyester resin" means a resin having the endothermic characteristics, among known polyester resins obtained by a polycondensation reaction of a divalent or higher-valent carboxylic acid (polyvalent carboxylic acid) and any derivative thereof with a dihydric or higher-hydric alcohol (polyhydric alcohol) and any derivative thereof. The melting point of the crystalline polyester resin is not particularly limited. The melting point of the crystalline polyester resin is preferably 55 to 90° C., more preferably 60 to 85° C. The melting point of the crystalline polyester resin can fall within the range, thereby allowing any charge to be sufficiently released in the course of melting in fixing of the toner to a recording medium. The melting point of the crystalline polyester resin can be controlled with the composition of the resin.

The melting point of the crystalline resin can be measured by, for example, the following method. The melting point of the crystalline resin is determined by encapsulating 3.0 mg of a sample into an aluminum pan, setting the resultant to a holder, setting an empty aluminum pan as a reference, and performing measurement with a differential scanning calorimeter measurement apparatus (Diamond DSC; manufactured by PerkinElmer Co. Ltd.) in measurement conditions (temperature-rising/cooling conditions) including a first temperature rising process of raising the temperature from 0° C. to 200° C. at a rising rate of 10° C./min, a cooling process of performing cooling from 200° C. to 0° C. at a cooling rate of 10° C./min, and a second temperature rising process of raising the temperature from 0° C. to 200° C. at a rising rate of 10° C./min to thereby provide a DSC curve. The maximum temperature of an endothermic peak derived from the crystalline resin in the first temperature rising process, based on the DSC curve, is defined as the melting point.

The respective valences of the polyvalent carboxylic acid and the polyhydric alcohol constituting the crystalline polyester resin are preferably 2 to 3, more preferably 2. There are here described a divalent dicarboxylic acid component and a dihydric diol component.

The divalent dicarboxylic acid component is preferably an aliphatic dicarboxylic acid, and such an aliphatic dicarboxylic acid may be, if necessary, used in combination with an aromatic dicarboxylic acid. The aliphatic dicarboxylic acid is preferably linear from the viewpoint of an enhancement in crystallinity. The dicarboxylic acid component may be used singly or in combinations of two or more kinds thereof.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid (dodecanedioic acid), 1,11-undecanedicarboxylic acid, 1,12-dodecanedicarboxylic acid (tetradecanedioic acid), 1,13-tridecanedicarboxylic acid, 1,14-tetradecanedicarboxylic acid, 1,16-hexadecanedicarboxylic acid, and 1,18-octadecanedicarboxylic acid.

The dicarboxylic acid component is preferably $C_{6-14}$ aliphatic dicarboxylic acid, more preferably $C_{8-14}$ aliphatic dicarboxylic acid.

Examples of the aromatic dicarboxylic acid that can be used in combination with the aliphatic dicarboxylic acid include phthalic acid, terephthalic acid, isophthalic acid, o-phthalic acid, t-butylisophthalic acid, 2,6-naphthalenedicarboxylic acid, and 4,4'-biphenyldicarboxylic acid. The aromatic dicarboxylic acid that can be used in combination with the aliphatic dicarboxylic acid is preferably terephthalic acid, isophthalic acid, or t-butylisophthalic acid from the viewpoint of availability and easiness of emulsification.

The polyvalent carboxylic acid that may be used is a trivalent or higher-valent polyvalent carboxylic acid such as trimellitic acid or pyromellitic acid, an anhydride of the carboxylic acid compound, or a $C_{1-3}$ alkyl ester.

The content of the aliphatic dicarboxylic acid under assumption that the amount of the dicarboxylic acid component for formation of the crystalline polyester resin is 100 mol % is preferably 50 mol % or more, more preferably 70 mol % or more, further preferably 80 mol % or more, particularly preferably 100 mol %. A content of 50 mol % or more can allow crystallinity of the crystalline polyester resin to be sufficiently ensured.

The divalent diol component is preferably an aliphatic diol, and such an aliphatic diol may be, if necessary, used in combination with any diol other than the aliphatic diol. The aliphatic diol is preferably linear from the viewpoint of an enhancement in crystallinity. The diol component may be used singly or in combinations of two or more kinds thereof.

Examples of the aliphatic diol include ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol neopentyl glycol.

The diol component is preferably $C_{2-12}$ aliphatic diol, more preferably $C_{3-10}$ aliphatic diol.

Examples of the diol that can be used in combination with the aliphatic diol include diols having a double bond. Examples of such a diol having a double bond include 1,4-butenediol, 2-butene-1,4-diol, 3-butene-1,6-diol, and 4-butene-1,8-diol.

The content of the aliphatic diol under assumption that the amount of the diol component for formation of the crystalline polyester resin is 100 mol % is preferably 50 mol % or more, more preferably 70 mol % or more, further preferably 80 mol % or more, particularly preferably 100 mol %. A content of the aliphatic diol in the diol component, of 50 mol % or more, can allow crystallinity of the crystalline polyester resin to be ensured.

Examples of polyhydric alcohols include trihydric or higher-hydric alcohols such as glycerin, pentaerythritol, trimethylolpropane, and sorbitol.

The weight average molecular weight (Mw) of the crystalline polyester resin is preferably 3,000 to 100,000, more preferably 4,000 to 50,000, particularly preferably 5,000 to 20,000 from the viewpoint that both sufficient low-temperature fixability and long-term heat-resistant storage stability are certainly satisfied. The ratio of the diol component and the dicarboxylic acid component to be used is preferably 1.5/1 to 1/1.5, more preferably 1.2/1 to 1/1.2 in terms of the ratio [OH]/[COOH] of the hydroxyl equivalent [OH] of the diol component and the carboxy equivalent [COOH] of the dicarboxylic acid component.

The method of synthesizing the crystalline polyester resin is not particularly limited, and such synthesis can be made by polycondensation (esterification) of the polyvalent carboxylic acid and the polyhydric alcohol with a known esterification catalyst.

Examples of the catalyst that can be used in synthesis of the crystalline polyester resin include a compound of any alkali metal such as sodium and lithium; a compound containing any II group element such as magnesium and calcium; a compound of any metal such as aluminum, zinc, manganese, antimony, titanium, tin, zirconium, and germanium; a phosphorus acid compound; a phosphoric acid compound; and an amine compound. Examples of the tin compound include dibutyltin oxide, tin octylate, tin dioctylate, and salts thereof. Examples of the titanium compound include titanium alkoxide such as tetra-n-butyl titanate, tetra-i-propyl titanate, tetramethyl titanate, and tetrastearyl titanate; titanium acrylate such as polyhydroxy titanium stearate; titanium chelate such as titanium tetraacetylacetonate, titanium lactate, and titanium triethanol aminate. Examples of the germanium compound include germanium dioxide. Examples of the aluminum compound include oxide such as polyaluminum hydroxide, aluminum alkoxide, and tributyl aluminate. Such compounds may be used singly or in combinations of two or more kinds thereof.

The content of the crystalline resin is preferably 5.0 mass % or more and 15.0 mass % or less based on the total amount of the binder resin included in the toner base particle. The content of the crystalline resin falls within the range, allowing an excellent discharging effect to be imparted, and also allowing excellent stabilization of the amount of charge with the crystalline resin being not exposed on the surface of the toner base particle.

(Amorphous Resin)

The binder resin may include not only the crystalline resin, but also an amorphous resin.

The amorphous resin has substantially no crystallinity, and includes, for example, an amorphous section in the resin. Examples of the amorphous resin include a vinyl resin, a urethane-based resin, a urea-based resin, an amorphous polyester resin, and a partially modified polyester resin. The amorphous resin preferably contains a vinyl resin. The amorphous resin can be synthesized by, for example, a known method. The amorphous resin may be used singly or in combinations of two or more kinds thereof.

The vinyl resin is a resin produced by polymerization of a monomer including a vinyl group-containing compound or any derivative thereof. Such a vinyl resin may be used singly or in combinations of two or more kinds thereof.

Examples of the vinyl resin include a styrene-(meth) acrylic resin. The styrene-(meth)acrylic resin has a molecule structure of a radical polymer of a compound having a radical-polymerizable unsaturated bond. The styrene-(meth) acrylic resin can be synthesized by, for example, radical polymerization of a compound having a radical-polymerizable unsaturated bond. The compound having a radical-polymerizable unsaturated bond may be used singly or in combinations of two or more kinds thereof. Examples of the compound having a radical-polymerizable unsaturated bond include styrene and derivatives thereof, and (meth)acrylic acid and derivatives thereof.

Examples of the styrene and derivatives thereof include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene.

Examples of the (meth)acrylic acid and derivatives thereof include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, and diethylaminoethyl methacrylate.

The content of the vinyl resin in the amorphous resin is preferably 50 mass % or more, more preferably 60 mass % or more, further preferably 70 mass % or more.

The content of the amorphous resin is preferably 50 mass % or more and 80 mass % or less based on the total amount of the binder resin included in the toner base particle. The content of the amorphous resin falls within the range, resulting in an increase in hardness of the binder resin, thereby allowing pulverizing resistance against mixing with the carrier particle to be enhanced.

The crystalline resin may also be a hybrid crystalline polyester resin. The hybrid crystalline polyester resin has a structure where a crystalline polyester resin unit and an amorphous resin unit are chemically bound.

The "crystalline polyester resin unit" represents a moiety derived from the crystalline polyester resin in the hybrid crystalline polyester resin. The "amorphous resin unit" represents a moiety derived from any resin (amorphous resin) having no crystallinity, in the hybrid crystalline polyester resin.

The crystalline polyester resin here usable is the above crystalline polyester resin. The amorphous resin here usable is the above amorphous resin.

The crystalline polyester resin unit and the amorphous resin unit may be continuously randomly disposed in the hybrid crystalline polyester resin as long as chemical binding between such crystalline polyester resin units, a chemical bond between such amorphous resin units, or a chemical bond between both these resins is made. Both of the units may be linearly linked, or one of the units may be linked to other of the units by graft binding.

Such a chemical bond is here, for example, an ester bond, or a covalent bond obtained by an addition reaction of an unsaturated group. The hybrid crystalline polyester resin can be obtained by binding the crystalline polyester resin unit and the amorphous resin unit via the chemical bond according to a known method. For example, the hybrid crystalline polyester resin can be synthesized by a method including polymerizing a monomer for constituting a resin unit in a main chain and a bireactive monomer, and polymerizing or reacting one of or both a monomer for constituting a resin unit in a side chain and a nucleating agent in the presence of the resulting main chain precursor.

Furthermore, any substituent such as a sulfonic acid group, a carboxyl group, and a urethane group can be introduced to the hybrid crystalline polyester resin. Such any substituent may be introduced into the crystalline polyester resin unit or the amorphous resin unit.

The structures and amounts of the main chain and side chain in the resulting resin can be confirmed or estimated by, for example, subjecting the binder resin or the hydrolyzed product thereof to a known instrumental analysis method such as nuclear magnetic resonance (NMR) or electrospray ionization mass spectrometry (ESI-MS).

In the synthesis of the resin unit, a chain transfer agent for adjustment of the molecular weight of a resin to be obtained may be further included in the raw materials of the resin units, for example, the monomers. The chain transfer agent may be used singly or in combinations of two or more kinds thereof. Examples of the chain transfer agent include 2-chloroethanol, mercaptan such as octylmercaptan, dodecylmercaptan, and t-dodecylmercaptan, and a styrene dimer.

The "graft bonding" here means a chemical bond between a polymer serving as a stem and a different polymer (or monomer) therefrom, serving as a branch. The hybrid crystalline polyester resin may have a structure the crystalline polyester resin unit is linked to the amorphous resin unit by graft bonding, from the viewpoint of a general improvement in predetermined characteristics of the toner.

The contents of the crystalline polyester resin unit and the amorphous resin unit in the hybrid crystalline polyester resin can be appropriately determined as long as the effects of the present embodiment are obtained. For example, a too low content of the amorphous resin unit in the hybrid crystalline polyester resin may result in insufficient dispersibility of the hybrid crystalline polyester resin into the toner base particle, and a too high content thereof may result in insufficient low-temperature stability. The content is preferably 5 to 30 mass % from such viewpoints, and is more preferably 5 to 20 mass % from the viewpoint of improvements in high-temperature storage ability and charging evenness.

The content of the crystalline polyester resin unit in the hybrid crystalline polyester resin is preferably 65 to 95 mass %, more preferably 70 to 90 mass % from the same viewpoints. The hybrid crystalline polyester resin may further contain any component other than both of the units as long as the effects of the present embodiment are obtained. Examples of such any other component include various additives to be added to other resin unit or other toner base particle.

The toner base particle may include any other component such as a colorant, a release agent (wax), and a charge control agent.

(Colorant)

Examples of the colorant include carbon black, a magnetic material, a dye, and a pigment. Examples of such carbon black include channel black, furnace black, acetylene black, thermal black, and lamp black. Examples of the magnetic material include a ferromagnetic metal such as iron, nickel, or cobalt, an alloy including such a metal, and a ferromagnetic metal compound such as ferrite or magnetite. Examples of the dye include C.I. Solvent Reds 1, 49, 52, 58, 63, 111, and 122, C.I. Solvent Yellows 19, 44, 77, 79, 81, 82, 93, 98, 103, 104, 112, and 162, C.I. Solvent Blues 25, 36, 60, 70, 93, and 95, and mixtures thereof. Examples of the pigment include C.I. Pigment Reds 5, 48:1, 48:3, 53:1, 57:1, 81:4, 122, 139, 144, 149, 166, 177, 178, and 222, C.I. Pigment Oranges 31 and 43, C.I. Pigment Yellows 14, 17, 74, 93, 94, 138, 155, 180, and 185. C.I. Pigment Green 7. C.I. Pigment Blues 15:3, 15:4, and 60, and mixtures thereof.

(Release Agent)

The release agent usable can be any of known various waxes. Examples of such waxes include polyolefin waxes such as polyethylene wax and polypropylene wax, branched hydrocarbon waxes such as microcrystalline wax, long-chain hydrocarbon-based waxes such as paraffin wax and Sasol wax, dialkyl ketone-based waxes such as distearyl ketone, carnauba wax, montan wax, ester-based waxes such as behenic acid behenate, trimethylolpropane tribehenate, pentaerythritol tetrabehenate, pentaerythritol diacetate dibehenate, glycerin tribehenate, 1,18-octadecanediol distearate, tristearyl trimellitate, and distearyl maleate, and amide-based waxes such as ethylene diamine behenyl amide and trimellitic acid tristearyl amide. The content of the release agent is preferably 0.1 to 30 parts by mass, more preferably 1 to 10 parts by mass based on 100 parts by mass of the binder resin. Such release agents may be used singly or in combinations of two or more kinds thereof. The melting point of the release agent is preferably 50 to 95° C. from the viewpoint of low-temperature fixability and releasability of toner.

(Charge Control Agent)

The charge control agent usable can be any known substance dispersed in an aqueous medium. Examples of the charge control agent include a nigrosine-based dye, a metal salt of a naphthenic acid or a higher fatty acid, alkoxylated amine, a quaternary ammonium salt compound, an azo-based metal complex, a salicylic acid metal salt, or a metal complex thereof.

(External Additive)

The external additive includes an alumina particle. The alumina here means aluminum oxide represented by $Al_2O_3$. The alumina is α-, γ- or σ-alumina, or a mixed form thereof. The shape of the alumina can be selected by control of a crystalline system, and examples include a cubic shape and a spherical shape. The alumina can be produced according to a known method. The method of producing the alumina, which can be usually applied, is a Bayer method, and can also be a hydrolysis method, a vapor-phase synthesis method, a flame hydrolysis method, or an underwater spark method in order that nano-sized alumina high in purity is obtained.

The percentage of an aluminum atom present in the surface of the toner particle is 0.80 atom % or more and 5.00 atom % or less, preferably 1.50 atom % or more and 4.0 atom % or less. A percentage of an aluminum atom present, falling within the range, can allow the amount of charge of the toner for electrostatic charge image development to be constantly kept and allow any charge to be emitted in fixation. A percentage of an aluminum atom present, of less than 0.80 atom %, causes any charge not to be sufficiently emitted in fixation of the toner for electrostatic charge image development. On the other hand, a percentage of an aluminum atom present, of more than 5.0 atom %, results in deterioration in the ability of the toner for electrostatic charge image development to retain the amount of charge.

The "percentage of an aluminum atom present" here means the percentage of an aluminum atom present in the surface of the toner particle. The percentage of an aluminum atom present is a value obtained by quantitative analysis of all elements in the surface of the toner particle with an X-ray photoelectron spectroscopy apparatus and calculation of the concentration of each atom in the surface of the toner particle from the peak area of each atom by use of a relative sensitivity factor. The surface of the toner particle here means an outermost surface of the toner particle and a location within 3 nm in depth from the outermost surface, as measured with an X-ray photoelectron spectroscopy apparatus in conditions described below.

The number average primary particle size of the alumina particle is preferably 10 nm or more and 40 nm or less, more preferably 15 nm or more and 30 nm or less. A number average primary particle size of the alumina particle, of less than 10 nm, may cause the alumina particle to be easily embedded on the surface of the toner base particle due to collision with the carrier particle, resulting in no stabilization of the amount of charge or unstable charge emission in fixation. On the other hand, a number average primary particle size of the alumina particle, of more than 40 nm, may make fixing onto the surface of the toner base particle difficult, resulting in contamination of the surface of the carrier particle and thus deterioration in image quality.

The number average primary particle size of the alumina particle is defined as the number average primary particle size obtained by capturing a photographic image taken with a scanning electron microscope (SEM) (JSM-7401F; manufactured by JEOL Ltd.), by a scanner, subjecting the alumina particle imaged in the photographic image to binarization with a processing analysis apparatus (LUZEX AP; manufactured by Nireco), then calculating the Feret size in the horizontal direction with respect to 100 of the alumina particles, to provide the average.

The surface of the alumina particle may be modified by a surface modifier. The alumina particle surface-modified has an alumina particle and a surface modifier residue located on the surface thereof. The surface modifier includes a reactive section to be reacted with a hydroxyl group on the surface of the alumina particle, and a non-reactive section not to be reacted with a hydroxyl group on the surface of the alumina particle. The alumina particle is surface-modified by the surface modifier, thereby allowing the surface modifier residue to be located on the surface of the alumina particle. The surface modifier residue is generally an organic group. The structure of the surface modifier residue can be selected depending on the surface modifier to be selected. Examples of the surface modifier residue include an alkyl group, an aryl group, and an alkoxy group.

Examples of the surface modifier include silazane represented by the following formula (A) and a silane coupling agent represented by the following formula (B).

$$(R_1,R_2,R_3)\text{—Si—NH—Si—}(R_1,R_2,R_3) \qquad \text{formula (A)}$$

$$(R_4)_{4-n}\text{—Si—}(OR_5)_n \qquad \text{formula (B)}$$

$R_1$ to $R_5$ each independently represent hydrogen, an alkyl group, an aryl group, or an alkoxy group, and may have a substituent, and $R_1$ to $R_5$ may be the same as or different from one another.

The silazane usable is known silazane as long as the effects of the present embodiment are not impaired. The silazane is preferably hexamethyldisilazane (in formula (A), $R_1$, $R_2$ and $R_3$ each represent a methyl group.) or hexamethyldisilazane (in formula (A), $R_1$, $R_2$ and $R_3$ each represent an ethyl group.), particularly preferably hexamethyldisilazane from the viewpoint of suppression of external additive particle aggregation and from the viewpoint of reactivity with the surface of the external additive particle.

The silane coupling agent usable is a known silane coupling agent as long as the effects of the present embodiment are not impaired. The silane coupling agent preferably includes a linear $C_{1-12}$ alkyl group. The linear alkyl group may have a substituent. $R_4$ in formula (B) can represent a $C_{1-12}$ alkyl group, thereby allowing the external additive particle to have a proper intermolecular force due to interaction of the alkyl groups, resulting in suppression of aggregation. The number of carbon atoms in $R_4$ is more preferably 4 to 8. The number of carbon atoms in $R_4$ may exceed 12 to cause aggregation ability to be increased, resulting in no sufficient effect to be exerted. $R_5$ in formula (B) is not particularly limited as long as the effects of the present embodiment are obtained. Examples of $R_5$ include a methyl group or an ethyl group. $R_5$ causes the alumina particle to be hardly surface-modified, if having a large functional group in terms of the steric structure, and thus more preferably represents a methyl group from the viewpoint of reactivity. Herein. $R_5$, which represents a hydrogen atom, is not preferable because formula (B) represents a compound having a hydroxyl group to thereby cause chemical affinity with water to be increased, resulting in a leakage point with respect to the amount of charge under a high-temperature and high-humidity environment.

In the case where silazane is used as the surface mxodifier, the following structure can be generated through a deamination reaction with a hydroxyl group on the surface of the alumina particle.

$$(Al^*\text{—O})_1\text{—Si(—}R_1,R_2,R_3)$$

[Al*: Atom on Alumina Surface]

In the case where alkoxysilane (silane coupling agent) is used as the surface modifier, the following structure can be generated through hydrolysis and a dehydration reaction.

$$(Al^*\text{—O})_n\text{—Si}(R_1)(OR_2)_{3-n}$$

A known method can be adopted for the method of surface-modifying the alumina particle. Examples of the surface-modifying method include a dry method and a wet method.

The dry method includes stirring or mixing the alumina particle and the surface modifier in a fluidized bed reactor. The wet method includes first dispersing the alumina particle in a solvent to form a slurry of the alumina particle, and then adding the surface modifier to the slurry to modify (hydrophobize) the surface of the alumina particle.

The alumina particle and the surface modifier are here preferably heated at 100 to 200° C. for 0.5 to 5 hours. Such a heating treatment can allow a hydroxyl group on the alumina surface to be effectively modified. The amount of the surface modifier is not particularly limited, and is preferably 5 to 30 parts by mass, more preferably 8 to 20 parts by mass based on 100 parts by mass of the alumina particle.

The volume resistivity of the alumina particle surface-modified is determined by forming the alumina particle surface-modified, into a pellet having a diameter of 20 mm and a thickness of 3.0 mm, under a pressure of 200 kg $cm^2$, and subjecting the pellet to measurement of the electrical resistance with a digital LCR meter (4261A; manufactured by Hewlett Packard Enterprise Development LP) in an environment of 20° C. and 50%.

The volume resistivity of the alumina particle surface-modified is preferably $1.0\times10^8$ Ω·cm or more and $1.0\times10^{13}$ Ω·cm or less, more preferably $1.0\times10^9$ Ω·cm or more and $1.0\times10^{11}$ Ω·cm or less. A volume resistivity of less than $1.0\times10^8$ Ω·cm may result in reduced charge retention, thereby causing the amount of charge of the toner to be reduced. A volume resistivity of more than $1.0\times10^{13}$ Ω·cm may cause charge in fixation to be hardly emitted.

The volume resistivity of the alumina particle is preferably higher than the dynamic resistivity of the carrier particle described below. A lower volume resistivity of the alumina particle than the dynamic resistivity of the carrier particle described below may cause a reduction in the amount of charge to occur after movement of charge to the carrier particle.

The number average primary particle size of the alumina particle surface-modified can be almost the same as the number average primary particle size of the alumina particle not surface-modified, and thus the description thereof is omitted.

The external additive may further include a silica particle in addition to the alumina particle. The silica particle can be produced by a known method such as a sol-gel method, a gas phase method (gas combustion method), and a melting method. The method of producing the silica particle is preferably a sol-gel method from the viewpoint of shape control. The method of producing the silica particle according to a sol-gel method is a method including each feeding tetraalkoxysilane and an alkali catalyst in the presence of an alcohol including an alkali catalyst and simultaneously reacting the tetraalkoxysilane. The gas phase method is a method including gasifying silicon chloride and synthesizing a silica fine particle in a hydrogen flame at a high temperature according to a gas phase reaction. The melting method is a method including thermally treating a mixed raw material of a reducing agent such as finely pulverized silica, a metallic silicon powder, or a carbon powder, and water for slurry formation, at a high temperature in a reducing atmosphere, to generate a SiO gas, and rapidly cooling the gas in an atmosphere including oxygen.

The number average primary particle size of the silica particle is preferably 70 nm or more and 150 nm or less. A number average primary particle size of the silica particle, of less than 70 nm, leads to a need for a strengthened transfer electric field that transfers the toner for electrostatic charge image development, to paper, to cause an image itself to easily retain electricity by the transfer electric field, resulting in pasting between recording media, in some cases. On the other hand, a number average primary particle size of the silica particle, of more than 150 nm, leads to an increase in the amount of the silica particle to be moved onto the surface of the carrier particle, to cause stabilization of the amount of charge and stabilization of flow properties of the toner to be impaired, in some cases.

The method of producing the toner for electrostatic charge image development is not particularly limited. Examples of the method of producing the toner for electrostatic charge image development include a kneading pulverization method, a suspension polymerization method, an emulsification aggregation method, a solution suspension method, a polyester elongation method, and a dispersion polymerization method. The method of producing the toner for electrostatic charge image development is preferably an emulsification aggregation method from the viewpoint of evenness of the particle size, and shape control.

The emulsification aggregation method is a method including mixing a dispersion of a particle of the binder resin (hereinafter, also referred to as "binder resin particle") dispersed by a surfactant and/or a dispersion stabilizer, if necessary, with a dispersion of a particle of the colorant (hereinafter, also referred to as "colorant particle"), aggregating the resultant until a desired toner particle size is obtained, and furthermore performing fusion of the binder resin particle to thereby perform shape control, thereby producing the toner particle. The binder resin particle may arbitrarily contain a release agent, a charge control agent, and the like. One example of the case of providing a toner particle having a core-shell structure with the emulsification aggregation method is shown below.

(1) A step of preparing a colorant particle dispersion where a colorant particle is dispersed in an aqueous medium (2) A step of preparing resin particle dispersions (respective resin particle dispersions for core/shell) where a binder resin particle containing, if necessary, an internal additive is dispersed in an aqueous medium (3) A step of mixing the colorant particle dispersion and the resin particle dispersion for core, to provide a resin particle dispersion for aggregation, and aggregating and fusing the colorant particle and the binder resin particle in the presence of an aggregating agent, to form an aggregated particle as a core particle (aggregation/fusion step)

(4) A step of adding the resin particle dispersion for shell, including a binder resin particle for a shell layer, into a dispersion including the core particle, to aggregate and fuse a particle for a shell layer, on the surface of the core particle, thereby forming a toner base particle having a core-shell structure (aggregation/fusion step)

(5) A step of separating the toner base particle from a dispersion of the toner base particle (toner base particle dispersion) by filtration, thereby removing a surfactant, and the like (washing step)

(6) A step of drying the toner base particle (drying step)

(7) A step of adding an external additive to the toner base particle (external additive treatment step).

A toner particle having a core-shell structure is produced by first producing a core particle by aggregation and fusion of a binder resin particle for a core particle, and a colorant particle, and then adding a binder resin particle for a shell layer into a dispersion of the core particle to aggregate and fuse the binder resin particle for a shell layer on the surface of the core particle, thereby forming a shell layer with which the surface of the core particle is covered. For example, however, a toner particle formed from a monolayer particle can also be similarly produced without addition of any resin particle dispersion for shell in step (4).

A mechanical mixing apparatus can be used in the external additive treatment step. Examples of the mechanical mixing apparatus include a Henschel mixer, a Nauta mixer, and a turbula mixer. The external additive treatment step may be performed by a mixing treatment for an elongated mixing time or at an increased rotational peripheral speed of a stirring blade by use of a mixing apparatus capable of providing a shear force to any particle like a Henschel mixer. In the case of use of a plurality of external additives, all the external additives may be collectively subjected to such a mixing treatment with the toner particle, or the external additives may be subjected in a plurality of portions to such a mixing treatment depending on the external additives. The method of mixing the external additive can allow the mechanical mixing apparatus used to control the mixing strength, namely, for example, the peripheral speed of a stirring blade, the mixing time, or the mixing temperature, thereby resulting in control of the degree of disintegration and the attachment strength, of the external additive.

The percentage of an aluminum atom present in the surface of the toner particle is 0.8 atom % or more and 5.0 atom % or less in the present embodiment, and thus a high image quality can be kept and pasting between recording media can be controlled in continuous printing at a high coverage rate.

EXAMPLES

Hereinafter, the present invention will be further specifically described with reference to Examples, but the present invention is not intended to be limited to such Examples.

<Preparation of Black Colorant Fine Particle Dispersion BK>

In 1,600 parts by mass of ion exchange water was dissolved 90 parts by mass of n-dodecyl sodium sulfate with stirring. Next, while the solution was stirred, 420 parts by mass of carbon black (Mogul L, pH 2 (room temperature, 25° C.); manufactured by Cabot Corporation) was gradually added thereto. Next, a dispersing treatment was performed with a stirring apparatus (Cleamix; manufactured by M Technique Co., Ltd.), thereby preparing black colorant fine particle dispersion BK where a carbon black particle was dispersed. The particle size of the black colorant fine particle in the dispersion was measured with a Microtrac particle size measurement apparatus (UPA-150; manufactured by Nikkiso Co. Ltd.), and the median size on a volume basis was 77 nm.

<Synthesis of Crystalline Polyester Resin c1>

A reaction vessel equipped with a stirring apparatus, a nitrogen gas introduction tube, a temperature sensor, and a rectifying column was charged with 200 parts by mass of dodecanedioic acid and 102 parts by mass of 1,6-hexanediol, the temperature of the reaction system was raised to 190° C.

over 1 hour, and the reaction system was confirmed to be evenly stirred. Next, 0.3 parts by mass of titanium tetrabutoxide was loaded as a catalyst. Furthermore, while water generated was distilled off, the temperature of the reaction system was raised from 190° C. to 240° C. over 6 hours. Furthermore, a dehydration and condensation reaction was continued for 6 hours with the temperature being kept at 240° C. to allow a polymerization reaction to run, thereby providing crystalline polyester resin c1. Crystalline polyester resin c1 obtained had a weight average molecular weight of 14.500 and a melting point of 70° C.

(Measurement of Weight Average Molecular Weight)

A GPC apparatus (HLC-8220; manufactured by Tosoh Corporation) and a column (TSKguard column+TSKgel Super HZM-M3 continuous; manufactured by Tosoh Corporation) were used, and while the column temperature was kept at 40° C., tetrahydrofuran (THF) as a carrier solvent was allowed to flow at a flow rate of 0.2 mL/min. The weight average molecular weight was determined by injecting 10 μL of a sample solution into the apparatus, performing detection with a refractive index detector (RI detector), and calculating the molecular distribution of such a measurement sample by use of the calibration determined with a monodisperse polystyrene standard particle.

(Measurement of Melting Point of Crystalline Polyester Resin)

The melting point of the crystalline polyester resin was measured with a differential scanning calorimeter measurement apparatus (Diamond DSC; manufactured by PerkinElmer Co., Ltd.). First, 3.0 mg of the crystalline polyester resin was encapsulated into an aluminum pan and the resultant was set to a holder, and an empty aluminum pan was set as a reference. Next, a first temperature rising process was performed where the temperature was raised from 0° C. to 200° C. at a rising rate of 10° C./min, a cooling process was performed where cooling was performed from 200° C. to 0° C. at a cooling rate of 10° C./min. and a second temperature rising process was performed where the temperature was raised from 0° C. to 200° C. at a rising rate of 10° C./min, thereby providing a DSC curve. Next, the maximum temperature of an endothermic peak derived from crystalline polyester in the first temperature rising process, based on the DSC curve, was defined as the melting point.

<Production of Crystalline Polyester Resin Particle Dispersion C1>

In 400 parts by mass of ethyl acetate was dissolved 100 parts by mass of crystalline polyester resin c1 obtained. The solution was mixed with 638 parts by mass of an aqueous dodecyl sodium sulfate solution having a concentration of 0.26 mass %, prepared in advance. While the resulting mixed liquid was stirred, an ultrasonic dispersing treatment was performed with an ultrasonic homogenizer (US-150T; manufactured by NISSEI Corporation) at a V-LEVEL of 300 μA for 30 minutes. Next, a diaphragm vacuum pump (V-700; manufactured by BUCHI Labortechnik AG) was used with the temperature being warmed at 50° C. to completely remove ethyl acetate under reduced pressure with stirring for 3 hours, thereby preparing crystalline polyester resin particle dispersion C1. The crystalline polyester resin particle in the dispersion had a median size on a volume basis, of 148 nm.

<Production of Styrene Acrylic Resin Particle Dispersion SPI for Core>

(First Stage Polymerization)

A reaction vessel equipped with a stirring apparatus, a temperature sensor, a condenser, and a nitrogen gas introduction apparatus was charged with 4 parts by mass of dodecyl sodium sulfate and 3,000 parts by mass of ion exchange water, and the interior temperature was raised to 80° C. with stirring at a stirring rate of 230 rpm under a nitrogen stream. Next, a solution where 10 parts by mass of potassium persulfate was dissolved in 200 parts by mass of ion exchange water was added, and a mixed liquid of the following monomers was dropped over 2 hours at a liquid temperature set again to 80° C.

| | |
|---|---|
| Styrene | 570.0 parts by mass |
| n-Butyl acrylate | 165.0 parts by mass |
| Methacrylic acid | 68.0 parts by mass |

After the mixed liquid was dropped, polymerization was performed with heating and stirring at 80° C. for 2 hours, thereby preparing styrene acrylic resin particle dispersion 1-a for core.

(Second Stage Polymerization)

A reaction vessel equipped with a stirring apparatus, a temperature sensor, a condenser, and a nitrogen introduction apparatus was charged with a solution where 3 parts by mass of sodium polyoxyethylene (2) dodecyl ether sulfate was dissolved in 1,210 parts by mass of ion exchange water, and the resultant was heated to 80° C. After the heating, 60 parts by mass of styrene acrylic resin particle dispersion 1-a for core, prepared in first stage polymerization, in terms of the solid content, and a mixed liquid where the following monomers, chain transfer agent and release agent were dissolved at 80° C. were added.

| | |
|---|---|
| Styrene (St) | 245.0 parts by mass |
| 2-Ethylhexyl acrylate (2EHA) | 97.0 parts by mass |
| Methacrylic acid (MAA) | 30.0 parts by mass |
| N-Octyl-3-mercaptopropionate | 4.0 parts by mass |
| Microcrystalline wax "HNP-0190" (manufactured by Nippon Seiro Co., Ltd.) | 170.0 parts by mass |

A mixing/dispersing treatment was performed with a mechanical dispersing machine (Cleamix; manufactured by M Technique Co., Ltd., "Cleamix" being a registered trademark of the Company) having a circulation route, for 1 hour, thereby preparing a dispersion including an emulsified particle (oil droplet). To the dispersion were added a solution of a polymerization initiator, where 5.2 parts by mass of potassium persulfate was dissolved in 200 parts by mass of ion exchange water, and 1,000 parts by mass of ion exchange water, and the system was heated and stirred at 84° C. over 1 hour to thereby perform polymerization, thereby preparing styrene acrylic resin particle dispersion 1-b for core.

(Third Stage Polymerization)

A solution where 7 parts by mass of potassium persulfate was dissolved in 130 parts by mass of ion exchange water was added to styrene acrylic resin particle dispersion 1-b for core, obtained in second stage polymerization. Furthermore, a mixed liquid of the following monomers and chain transfer agent was dropped in a temperature condition of for 82° C. over 1 hour.

| | |
|---|---|
| Styrene (St) | 350 parts by mass |
| Methyl methacrylate (MMA) | 50 parts by mass |
| n-Butyl acrylate (BA) | 170 parts by mass |
| Methacrylic acid (MAA) | 35 parts by mass |
| N-Octyl-3-mercaptopropionate | 8.0 parts by mass |

After the dropping, the resultant was subjected to polymerization with heating and stirring over 2 hours, and then cooled to 28° C., thereby preparing styrene acrylic resin particle dispersion SPI for core. The styrene acrylic resin particle in the dispersion had a median size on a volume basis, of 145 nm. The resulting styrene acrylic resin had a weight average molecular weight of 35,000 and a glass transition temperature (Tg) of 37° C.

(Measurement of Glass Transition Temperature)

The glass transition point was a value measured according to the method (DSC method) prescribed in ASTM (American Society for Testing and Materials) D3418-82. Specifically, 4.5 mg of a sample was weighed to two decimal places, encapsulated in an aluminum pan, and placed on a sample holder of a differential scanning calorimeter (DSC8500; manufactured by PerkinElmer Co., Ltd.). An empty aluminum pan was used as a reference, a temperature control of Heat-Cool-Heat, including a measurement temperature of −0 to 120° C., a rate of temperature rise of 10° C./min, and a rate of temperature drop of 10° C./min, was performed, and analysis was performed based on the data at the second Heat. The glass transition temperature was defined as the value at the intersection of the extended line of the baseline before the rise of the first endothermic peak with the tangent line indicating the maximum gradient between the rise of the first endothermic peak and the peak top.

<Synthesis of Amorphous Polyester Resin d1>

A reaction tank equipped with a condenser, a stirring machine and a nitrogen introduction tube was loaded with 360 parts by mass of a bisphenol A propylene oxide 2-mol adduct, 80 parts by mass of terephthalic acid, 55 parts by mass of fumaric acid, and 2 parts by mass of titanium tetraisopropoxide as a polycondensation catalyst in 10 portions, and the resultant was subjected to a reaction for 10 hours with distilling off of water generated under a nitrogen stream at 200° C. Next, the reaction was performed under a reduced pressure of 13.3 kPa (100 mmHg), and the resultant was taken out at the point where the softening point reached 100° C., thereby synthesizing amorphous polyester resin d1.

<Preparation of Polyester Resin Particle Dispersion D1>

In 400 parts by mass of ethyl acetate was dissolved 100 parts by mass of the resulting amorphous polyester resin. The solution was mixed with 638 parts by mass of an aqueous dodecyl sodium sulfate solution having a concentration of 0.26 mass %, prepared in advance. While the resulting mixed liquid was stirred, an ultrasonic dispersing treatment was performed with an ultrasonic homogenizer at a V-LEVEL of 300 μA for 30 minutes.

Thereafter, a diaphragm vacuum pump was used with warming at 50° C., and ethyl acetate was completely removed under reduced pressure for 3 hours, thereby preparing amorphous polyester resin particle dispersion D1. The amorphous polyester resin particle in the dispersion had a median size on a volume basis, of 180 nm.

<Production of Toner Base Particle (Aggregation/Fusion Step)>

A 5-L reaction vessel equipped with a stirring apparatus, a temperature sensor, a condenser and a nitrogen introduction apparatus was charged with 435 g (in terms of the solid content) of a dispersion of resin fine particle SPI for core, 15 g (in terms of the solid content) of crystalline polyester resin particle dispersion C1, 1,100 g of ion exchange water, and 50 g of colorant fine particle dispersion BK, and the temperature of the resulting dispersion was adjusted to 30° C. Next, an aqueous 5 N sodium hydroxide solution was added to the dispersion to adjust the pH of the dispersion to 10. Next, an aqueous solution where 60 g of magnesium chloride was dissolved in 60 g of ion exchange water was added to the dispersion under stirring at 30° C. over 10 minutes. After the addition, the dispersion was kept at 30° C. for 3 minutes, thereafter the temperature was started to rise, the dispersion was heated to 85° C. over 60 minutes, and a particle growth reaction was continued with the temperature of the dispersion being kept at 85° C., thereby preparing a dispersion of pre-core particle 1. Thereto was added 50 g (in terms of the solid content) of resin fine particle D1 for shell, stirring was continued at 80° C. over 1 hour, resin fine particle D1 for shell was fused onto the surface of core particle 1 to form a shell layer, thereby providing resin particle 1. To the resulting dispersion was added an aqueous solution where 150 g of sodium chloride was dissolved in 600 g of ion exchange water, and the resultant was aged at a liquid temperature of 80° C., and cooled to 30° C. at the point where the average degree of circularity of resin particle 1 was 0.970. The toner base particle after the cooling had a median size on a number basis, of 5.5 μm.

<Production of Alumina Particle 1>

320 kg/h of aluminum trichloride ($AlCl_3$) was evaporated at about 200° C. in an evaporation apparatus, and the vapor of chloride was allowed to pass through a burner mixing chamber with nitrogen. A gas stream was here mixed with 100 $nm^3$/h of hydrogen and 450 $nm^3$/h of air, and fed to flame via a central tube (diameter: 7 mm). As a result, the burner temperature was 230° C. and the rate of discharge from the tube was about 56 m/s. Fed was 0.05 $nm^3$/h of hydrogen serving as a jacket-type gas via an outer tube. The gas was burned in a reaction chamber, and cooled to about 110° C. in an aggregation zone located downstream. A primary particle of alumina was here aggregated. The resulting aluminum particle was separated from a hydrochloric acid-containing gas simultaneously generated, in a filter or a cyclone, and a powder having wet air was treated at about 500 to 700° C., resulting in removal of adhesive chloride. Thus, alumina particle 1 was obtained.

<Production of Alumina Particles 2 to 5>

Alumina particles 2 to 5 were obtained in the same manner as in alumina particle 1 except that the rate of discharge of the aluminum trichloride was changed to 49, 38, 32 and 27 nm/s, respectively.

<Production of External Additive 1>

Alumina particle 1 obtained was placed in a reaction vessel, and 18 g of a surface modifier, isobutyltrimethoxysilane, diluted with 60 g of hexane was added to 100 g of an alumina powder with such a powder being stirred by a rotational blade under a nitrogen atmosphere, and the resultant was heated and stirred at 200° C. for 120 minutes, thereafter cooled by cooling water and dried under reduced pressure, thereby providing external additive 1 of the alumina particle.

<Production of External Additives 2 to 5>

External additive 2 to 5 were obtained in the same manner as in external additive 1 except that the alumina particle was changed to alumina particles 2 to 5 and the content of the surface modifier was changed to 14.0, 8.0, 5.2, and 4.5, respectively.

<Production of External Additives 6 to 10>

External additives 6 to 10 were obtained in the same manner as in external additive 1 except that the alumina particle was changed to alumina particle 3 and the content of the surface modifier was changed to 3.3, 3.8, 10.2, 14.2, and 14.8, respectively.

<Production of External Additive 11>

A 1-L reactor equipped with a stirring machine, a dropping funnel and a thermometer was charged with 500 parts by mass of methanol for stirring, 10 parts by mass of titanium isopropoxide was dropped thereinto, and stirring was continued for 15 minutes. Thereafter, the titanium oxide fine particle produced was subjected to a centrifuge machine and thus separated and recovered, and thereafter dried under reduced pressure, thereby providing amorphous titanium oxide. The resulting amorphous titanium oxide was heated in a high-temperature electric furnace in the air at 800° C. for 5 hours, thereby providing a rutile-type titanium oxide fine particle. A 3-L reactor equipped with the stirring machine, dropping funnel and thermometer was charged with 100 parts by mass of the resulting rutile-type titanium oxide fine particle and 15 parts by mass of isobutyltrimethoxysilane, and the mixture was stirred in toluene for 10 hours, to modify the surface of the rutile-type titanium oxide fine particle. Thereafter, a reaction product was centrifuged to wash a reaction solvent, then again centrifuged and recovered, and dried under reduced pressure, thereby providing external additive 11.

Table 1 shows each core material used, the number average primary particle size of each of the external additives obtained, the amount of each surface modifier used, and the volume resistance value of each of the external additives obtained.

TABLE 1

| External additive No. | Type of core material | Number average primary particle size (μm) | Amount of surface modifier (parts by mass) | Volume resistance value |
|---|---|---|---|---|
| 1 | Alumina 1 | 8 | 18.0 | $8.8 \times 10^9$ |
| 2 | Alumina 2 | 10 | 14.0 | $8.4 \times 10^9$ |
| 3 | Alumina 3 | 20 | 8.0 | $8.5 \times 10^9$ |
| 4 | Alumina 4 | 40 | 5.2 | $8.7 \times 10^9$ |
| 5 | Alumina 5 | 50 | 4.5 | $8.6 \times 10^9$ |
| 6 | Alumina 3 | 20 | 3.3 | $7.5 \times 10^7$ |
| 7 | Alumina 3 | 20 | 3.8 | $1.0 \times 10^8$ |
| 8 | Alumina 3 | 20 | 10.2 | $4.5 \times 10^{10}$ |
| 9 | Alumina 3 | 20 | 14.2 | $9.8 \times 10^{12}$ |
| 10 | Alumina 3 | 20 | 14.8 | $2.2 \times 10^{13}$ |
| 11 | Titania | 20 | 14.3 | $8.8 \times 10^9$ |

<Production of Silica Particle A Used in Combination>

In a conical flask was weighed 347.4 g of pure water, 110 g of tetramethoxysilane (TMOS) was added thereto under stirring, and the mixture was stirred as it was for 1 hour, thereby preparing 457.4 g of a TMOS hydrolysis liquid. Next, 2,250 g of pure water and 112 g of ethylenediamine were placed into a 3-L reactor equipped with a stirring machine, a dropping funnel and a thermometer, and mixed. The solution was adjusted so as to be at 35° C., half (228.7 g) the total amount of the TMOS hydrolysis liquid was added at 2.5 mL/in with stirring. Next, such a state was kept for 30 minutes, and thereafter 4.5 g of an aqueous 1 mmol/g ethylenediamine solution was added to adjust the pH to 8 (35° C.).

Thereafter, the remaining TMOS hydrolysis liquid was added at 2.5 mL/min every 3 hours with an alkali catalyst (aqueous 1 mmol/g ethylenediamine solution) being appropriately added in order to keep the pH to 8 (35° C.), and such an operation was continued to add 457.4 g of such a liquid in total.

Stirring was continued for additional 0.5 hours to perform condensation even after completion of dropping of the TMOS hydrolysis liquid, thereby providing a dispersion of a hydrophilic spherical silica particle in a mixed medium. The resulting silica particle had a particle size (number average primary particle size) of 80 nm.

Next, a solution where 15 parts by mass of hexamethyldisilazane was mixed with 50 parts by mass of ethanol was prepared, and sprayed by spray-drying to the silica particle obtained above having a number average primary particle size of 80 nm, thereby surface-modifying the silica particle. Next, the silica particle was heated to 80° C. for removal of ethanol, and thereafter the silica particle was further surface-modified with stirring at 250° C. for 2 hours, thereby providing silica particle A.

<Production of Toner 1 (External Additive Treatment Step)>

The following external additive was added to toner base particle 1, the resultant was added into a Henschel mixer (FM20C/I; manufactured by Nippon Coke & Engineering. Co., Ltd.) and stirred for 15 minutes with the number of rotations of a stirring blade being set so that the peripheral speed of the tip of the blade was 40 m/s, thereby producing toner particle 1.

| | |
|---|---|
| External additive 3 | 0.5 parts by mass |
| Silica particle A | 2.4 parts by mass |

The temperature in mixing of the external additive particle with toner particle 1 was set so as to be 40° C.±1° C. In the case where the temperature was 41° C. cooling water was allowed to flow to an outer bath of the Henschel mixer at a flow rate of the cooling water, of 5 L/min, and in the case where the temperature was 39° C., cooling water was allowed to flow at a flor rate of the cooling water, of 1 L/min, thereby allowing the temperature in the Henschel mixer to be controlled.

<Production of Toners 2 to 11>

Toners 2 to 11 were obtained in the same manner as in toner 1 except that the external additive was changed to external additives 1, 2, 4, 5, 11 and 6 to 10, respectively.

Table 2 shows the type and the content of each of the external additives.

TABLE 2

| Toner No. | External additive No. | External additive (parts by mass) |
|---|---|---|
| 1 | 3 | 0.50 |
| 2 | 1 | 0.50 |
| 3 | 2 | 0.50 |
| 4 | 4 | 0.50 |
| 5 | 5 | 0.50 |
| 6 | 11 | 0.50 |
| 7 | 6 | 0.50 |
| 8 | 7 | 0.50 |
| 9 | 8 | 0.50 |
| 10 | 9 | 0.50 |
| 11 | 10 | 0.50 |

(Production of Covering Material 1)

Cyclohexyl methacrylate and methyl methacrylate were added at a molar ratio of 1:1 into an aqueous 0.3 mass % sodium benzenesulfonate solution, and potassium persulfate was added in an amount corresponding to 0.5 mass % of the total amount of the monomers, to perform emulsion polymerization. The resin particle in the resulting dispersion was dried by spray-drying, thereby producing covering material 1 as a resin for covering a core material. Covering material 1 obtained had a weight average molecular weight (Mw) of 500,000. The weight average molecular weight (Mw) of covering material 1 was determined by gel permeation chromatography (GPC).

(Production of Core Material Particle 1)

Respective raw materials were appropriately compounded so that the amount in terms of MnO was 19.0 mol %, the amount in terms of MgO was 2.8 mol %, the amount in terms of SrO was 1.5 mol % and the amount in terms of Fe2O3 was 75.0 mol %, water was added thereto, the resultant was pulverized and mixed by a wet ball mill for 10 hours, dried and kept at 950° C. for 4 hours, and thereafter pulverized by a wet ball mill for 24 hours to provide a slurry, the slurry was granulated and dried, then added in an amount corresponding to 50% of the volume of a sintering furnace provided with a built-in stirring apparatus, kept at 1,300° C. at a peripheral speed of 10 m/s for 4 hours, then disintegrated, and adjusted to a particle size of 32 mm, thereby providing core material particle 1. The shape factor (SF-1) of the core material particle, measured by the above method, was 140.

(Production of Core Material Particles 2 to 6)

Core material particles 2 to 6 were obtained in the same manner as in core material particle 1 except that the sintering temperature was changed to 1,500, 1,450, 1,350, 1,200, and 1,150° C., respectively.

Table 3 shows the sintering temperature and the SF-1 of each of the core material particles.

TABLE 3

| Core material particle No. | Sintering temperature (° C.) | SF-1 |
|---|---|---|
| 1 | 1300 | 140 |
| 2 | 1500 | 110 |
| 3 | 1450 | 115 |
| 4 | 1350 | 130 |
| 5 | 1200 | 150 |
| 6 | 1150 | 155 |

(Production of Carrier Particle 1)

A Mn—Mg-based ferrite particle having a volume average size of 32 μm and a shape factor SF-1 of 140 was prepared as a core material particle. A high-speed stirring-mixing machine equipped with a horizontal stirring blade was charged with 100 parts by mass of the ferrite particle and 4.1 pans by mass of a covering material, and the resultant was mixed and stirred at 22° C. for 15 minutes in a condition where the peripheral speed of a horizontal rotor was 8 m/sec. Thereafter, mixing was performed at 120° C. for 50 minutes to cover the surface of the core material particle with the covering material by the action of a mechanical impact force (mechanochemical method), thereby producing carrier particle 1. Carrier particle 1 had a median size on a volume distribution basis, of 33 μm. The core material particle had a percentage of exposed area of 8.2%.

(Production of Carrier Particles 2 to 6)

Carrier particles 2 to 6 were obtained in the same manner as in carrier particle 1 except that the content of the covering material was changed to 3.95, 3.20, 2.90, 1.95, and 1.80 parts by mass, respectively.

(Production of Carrier Particle 7)

Carrier particle 7 was obtained in the same manner as in carrier particle 1 except that the core material particle was changed to core material particle 2 and the content of the covering material was changed to 2.65 parts by mass.

(Production of Carrier Particle 8)

Carrier particle 8 was obtained in the same manner as in carrier particle 1 except that the core material particle was changed to core material particle 3 and the content of the covering material was changed to 2.75 parts by mass.

(Production of Carrier Particle 9)

Carrier particle 9 was obtained in the same manner as in carrier particle 1 except that the core material particle was changed to core material particle 4 and the content of the covering material was changed to 2.90 parts by mass.

(Production of Carrier Particle 10)

Carrier particle 10 was obtained in the same manner as in carrier particle 1 except that the core material particle was changed to core material particle 5 and the content of the covering material was changed to 3.35 parts by mass.

(Production of Carrier Particle 11)

Carrier particle 11 was obtained in the same manner as in carrier particle 1 except that the core material particle was changed to core material particle 6 and the content of the covering material was changed to 3.45 parts by mass.

(Production of Carrier Particle 12)

Carrier particle 12 was obtained in the same manner as in carrier particle 1 except that the core material particle was changed to core material particle 2 and the content of the covering material was changed to 2.85 parts by mass.

(Production of Carrier Particle 13)

Carrier particle 13 was obtained in the same manner as in carrier particle 1 except that the core material particle was changed to core material particle 2 and the content of the covering material was changed to 2.3 parts by mass.

(Production of Carrier Particle 14)

Carrier particle 14 was obtained in the same manner as in carrier particle 1 except that the core material particle was changed to core material particle 6 and the content of the covering material was changed to 3.8 parts by mass.

(Production of Carrier Particle 15)

Carrier particle 15 was obtained in the same manner as in carrier particle 1 except that the core material particle was changed to core material particle 6 and the content of the covering material was changed to 2.95 parts by mass.

The percentage of exposed area and the dynamic resistance value of each of the core material particles were measured by the respective methods.

Table 4 shows the respective contents of the core material particle and the covering material of each of the carrier particles, and the percentage of exposed area and the dynamic resistance value of each of the carrier particles.

TABLE 4

| Carrier particle No. | Core material particle No. | Core material (parts by mass) | Covering material (parts by mass) | Percentage of exposed area (%) | Dynamic resistance value (Ω · cm) |
|---|---|---|---|---|---|
| 1 | 1 | 140 | 4.10 | 3.5 | $2.5 \times 10^{11}$ |
| 2 | 1 | 140 | 3.95 | 4.0 | $1.0 \times 10^{11}$ |
| 3 | 1 | 140 | 3.20 | 8.2 | $4.5 \times 10^{10}$ |
| 4 | 1 | 140 | 2.90 | 10.9 | $7.8 \times 10^{9}$ |
| 5 | 1 | 140 | 1.95 | 15.0 | $1.5 \times 10^{8}$ |
| 6 | 1 | 140 | 1.80 | 15.2 | $8.4 \times 10^{7}$ |
| 7 | 2 | 110 | 2.65 | 7.9 | $8.2 \times 10^{9}$ |
| 8 | 3 | 115 | 2.75 | 8.1 | $8.4 \times 10^{9}$ |
| 9 | 4 | 130 | 2.90 | 7.9 | $8.3 \times 10^{9}$ |
| 10 | 5 | 150 | 3.35 | 8.0 | $7.5 \times 10^{9}$ |
| 11 | 6 | 155 | 3.45 | 7.9 | $7.8 \times 10^{9}$ |
| 12 | 2 | 110 | 2.85 | 3.6 | $2.2 \times 10^{11}$ |
| 13 | 2 | 110 | 2.30 | 15.3 | $2.2 \times 10^{8}$ |
| 14 | 6 | 155 | 3.80 | 3.8 | $1.5 \times 10^{11}$ |
| 15 | 6 | 155 | 2.95 | 15.2 | $1.9 \times 10^{8}$ |

<Production of Two-Component Developer 1>

Two-component developer 1 was obtained by mixing toner 1 and carrier particle 3 in a V-type mixing machine for 30 minutes so that the content (toner concentration) of the toner in a two-component developer was 6 mass %.

<Production of Two-Component Developers 2 to 11 and 22 to 25>

Two-component developers 2 to 11 and 22 to 25 were obtained in the same manner as in two-component developer 1 except that the carrier particle was changed to carrier particles 1, 2 and 4 to 15, respectively.

<Production of Two-Component Developers 12 to 21>

Two-component developers 12 to 21 were obtained in the same manner as in two-component developer 1 except that the toner particle was changed to toner particles 2 to 11, respectively.

<Evaluation Method>

The evaluation apparatus used was commercially available digital full-color multifunctional peripherals "bizhub PRESS 1070" (manufactured by Konica Minolta, Inc., "bizhub" being a registered trademark of the Company). Each of the two-component developers produced was packed, and the following evaluations were performed. The present evaluation apparatus allowed printing to be performed by an electrophotographic image forming method including a charging step, an exposing step, a developing step and a transferring step.

(Evaluation of Fogging)

A solid band chart having a coverage rate of 40% was printed on 100,000 sheets in an environment of 20° C. and 50% RH, thereafter white paper was subjected to such printing, and the density of the white paper was evaluated. The density was measured at 20 points in an A4-sized region, and the average thereof was defined as the density of the white paper. The density was measured with X-Rite 938 (X-Rite Inc.). Rating "A" or "B" in the following criteria was determined as being acceptable.

A: the density of the white paper was less than 0.005

B: the density of the white paper was 0.005 or more and less than 0.02

C: the density of the white paper was 0.02 or more (Evaluation of Variation in Image Density)

A solid band chart having a coverage rate of 40% was printed on 100,000 sheets in an environment of 20° C. and 50% RH, thereafter an image pattern where a solid patch of 2 cm square was aligned with respect to one development sleeve loop was output, the difference between the density (a) in one sleeve loop and the density (b) after one sleeve loop was measured with X-Rite 938 (X-Rite Inc.), and rating A" or "B" in the following criteria was determined as being acceptable.

A: the difference Δ in density was less than 0.005

B: the difference Δ in density was 0.005 or more and less than 0.02

C: the difference Δ in density was 0.02 or more

Table 5 shows constituent components of each of the two-component developers, and evaluation results of each of the two-component developers obtained.

TABLE 5

| | | | Fogging | | Variation in image density | |
|---|---|---|---|---|---|---|
| Two-component developer No. | Toner No. | Carrier particle No. | Measurement value | Evaluation result | Measurement value | Evaluation result |
| 1 | 1 | 3 | 0.003 | A | −0.001 | A |
| 2 | 1 | 1 | 0.019 | B | −0.013 | B |
| 3 | 1 | 2 | 0.017 | B | −0.008 | B |
| 4 | 1 | 4 | 0.004 | A | +0.003 | A |
| 5 | 1 | 5 | 0.017 | B | +0.014 | B |
| 6 | 1 | 6 | 0.018 | B | +0.015 | B |
| 7 | 1 | 7 | 0.017 | B | +0.004 | A |
| 8 | 1 | 8 | 0.009 | B | +0.002 | A |
| 9 | 1 | 9 | 0.004 | A | +0.002 | A |
| 10 | 1 | 10 | 0.013 | B | +0.009 | B |
| 11 | 1 | 11 | 0.017 | B | +0.011 | B |
| 12 | 2 | 3 | 0.018 | B | −0.015 | B |
| 13 | 3 | 3 | 0.011 | B | −0.008 | B |
| 14 | 4 | 3 | 0.003 | A | +0.003 | A |
| 15 | 5 | 3 | 0.010 | B | +0.014 | B |
| 16 | 6 | 3 | 0.042 | C | +0.022 | C |
| 17 | 7 | 3 | 0.017 | B | +0.012 | B |
| 18 | 8 | 3 | 0.010 | B | +0.007 | B |
| 19 | 9 | 3 | 0.003 | A | −0.002 | A |
| 20 | 10 | 3 | 0.002 | A | −0.004 | A |
| 21 | 11 | 3 | 0.002 | A | −0.007 | B |
| 22 | 1 | 12 | 0.023 | C | +0.017 | B |
| 23 | 1 | 13 | 0.025 | C | −0.021 | C |
| 24 | 1 | 14 | 0.018 | B | −0.028 | C |
| 25 | 1 | 15 | 0.026 | C | +0.021 | C |

As shown in Table 5, two-component developer 1 to 15 and 17 to 21, each having a percentage of exposed area of the core material particle on the surface of the carrier particle at the primary stage, of 4.0% or more and 15.0% or less, allowed for a sufficient image quality and suppression of the occurrence of fogging.

On the other hand, two-component developer 22 having a percentage of exposed area of less than 4.0% and a shape factor of the core material particle, of less than 115, allowed for no sufficient suppression of the occurrence of fogging. Moreover, two-component developer 23 having a percentage of exposed area of more than 15.0% and a shape factor of the core material particle, of less than 115, allowed for neither sufficient suppression of the occurrence of fogging, nor a sufficiently suppressed variation in image density. The reason is considered because of deterioration in charging retention ability due to polishing of the covering section by the alumina particle.

Two-component developer 24 having a percentage of exposed area of less than 4.0% and a shape factor of the core material particle, of more than 150, allowed for no sufficiently suppressed variation in image density. Two-component developer 25 having a percentage of exposed area of more than 15.0% and a shape factor of the core material particle, of more than 150, allowed for neither sufficient suppression of the occurrence of fogging, nor a sufficiently suppressed variation in image density. The reason is considered because of easy broadening of the distribution of the amount of charge due to a low fluidity of the carrier particle surface-modified and thus inferior mixability with the toner particle.

INDUSTRIAL APPLICABILITY

An image formed by the two-component developer for electrostatic charge image development according to the present invention is high in quality and less causes pasting between recording media. Accordingly, the present invention is expected to allow the two-component developer to be further widely used in an electrophotographic image forming method.

Although embodiments of the present invention have been described and illustrated in detail, it is clearly understood that the same is by way of illustration and example only and not limitation, the scope of the present invention should be interpreted by terms of the appended claims.

What is claimed is:

1. A two-component developer for electrostatic charge image development, comprising:

a toner particle comprising a toner base particle and an external additive disposed on a surface of the toner base particle; and a carrier particle comprising a core material particle and a cover disposed on a surface of the core material particle, wherein the external additive comprises an alumina particle, and a percentage of exposed area of the core material particle is 4.0% or more and 8.2% or less.

2. A two-component developer for electrostatic charge image development, comprising:

a toner particle comprising a toner base particle and an external additive disposed on a surface of the toner base particle; and a carrier particle comprising a core material particle and a cover disposed on a surface of the core material particle, wherein the external additive comprises an alumina particle, and a shape factor of the core material particle is 130 to 150.

3. The two-component developer for electrostatic charge image development according to claim 1, wherein a dynamic resistivity of the carrier particle is $1.0\times10^{8}$ Ω·cm or more and $1.0\times10^{11}$ Ω·cm or less.

4. The two-component developer for electrostatic charge image development according to claim 1, wherein a volume resistivity of the alumina particle is higher than a dynamic resistivity of the carrier particle.

5. The two-component developer for electrostatic charge image development according to claim 1, wherein a number average primary particle size of the alumina particle is 10 nm or more and 40 nm or less.

6. The two-component developer for electrostatic charge image development according to claim 1, wherein the cover comprises a cycloalkyl group-containing resin.

* * * * *